United States Patent [19]

McCoy, Jr.

[11] 4,438,635

[45] Mar. 27, 1984

[54] EVAPORATIVE CONDENSER REFRIGERATION SYSTEM

[76] Inventor: William J. McCoy, Jr., 1029 Southgate Rd., Knoxville, Tenn. 37919

[21] Appl. No.: 240,565

[22] Filed: Mar. 4, 1981

[51] Int. Cl.[3] ..... F28D 5/00

[52] U.S. Cl. ..... 62/305; 62/91; 62/171

[58] Field of Search ..... 62/304, 305, 509, 171, 62/196 A, 279, 428, 89, 91, 314, 315, 316; 261/23 R, 147

[56] References Cited

U.S. PATENT DOCUMENTS

| | | | |
|---|---|---|---|
| 3,435,631 | 4/1969 | Wood | 62/305 |
| 4,028,440 | 6/1977 | Engalitcheff, Jr. | 62/305 |
| 4,231,229 | 11/1980 | Willitts | 62/509 |

*Primary Examiner*—Albert J. Makay
*Assistant Examiner*—Henry Bennett
*Attorney, Agent, or Firm*—Burns, Doane, Swecker & Mathis

[57] ABSTRACT

The present invention relates to a method and apparatus for operating an evaporative condenser refrigeration system at a low condensing temperature. The refrigeration system includes a condenser, an evaporator, a compressor, and a coolant flowing therethrough. The condenser is sized for sufficient capacity for operation at the annual average wet bulb temperature of the locality of the refrigeration system. The evaporative condenser is operated at full capacity at all times during operation of the refrigeration system. The temperature of the incoming coolant fluid to the condenser is permitted to follow the prevailing wet bulb temperature of the locality. By operating at a low condensing temperature, a compressor arranged in the refrigeration system operates at the lowest practical horsepower requirement. Further, according to the preferred embodiment of the present invention the capacity of a compressor delivering working fluid to the condenser is controlled to ensure that the desired refrigeration load on the evaporator is maintained while using the minimum required compressor horsepower.

12 Claims, 4 Drawing Figures

EVAPORATIVE CONDENSER
SELECTION FACTORS FOR
AMMONIA AT 20°F SUCTION TEMPERATURE

EVAPORATIVE CONDENSER REFRIGERATION SYSTEM

BACKGROUND AND SUMMARY OF THE PRESENT INVENTION

The present invention relates generally to refrigeration systems. More particularly, the present invention relates to a method and apparatus for operating an evaporative condenser refrigeration system at a low condensing temperature.

In a typical evaporative condenser refrigeration system, the condenser capacity is generally selected based upon the highest wet bulb temperature occuring in the area of use of the refrigeration system, i.e., the condenser capacity is designed for the extreme condition. A compressor delivers working fluid, such as ammonia, to be condensed at a pressure generally in the range of 165 to 185 pounds per square inch. In order to artificially maintain this pressure at wet bulb temperatures considerably below the design condition, a mechanism for controlling condenser capacity is employed. This mechanism may include a device for regulating the speed, or operating time, of a fan for moving air over the evaporative condenser. Another control system regulates the flow of cooling water to nozzles which spray water upon coils of the evaporative condenser.

The prior systems have functioned satisfactorily and are acceptable if energy for driving a compressor to maintain the pressure of the working fluid at the predetermined high level is plentiful and inexpensive. However, with the increasing cost of energy a more economical refrigeration system is desirable.

It has been found that the highest wet bulb temperature within a region is considerably higher than the average wet bulb temperature on a yearly basis. However, in order to take full advantage of the annual average wet bulb temperature a different concept of refrigeration system operation is required. A refrigeration system having an evaporative condenser selected in accordance with the annual average wet bulb temperature produces a significant decrease in the amount of power required to operate the compressor. This decrease in the compressor power requirement is due primarily to a generally reduced compressor discharge pressure into the evaporative condenser. However, a system having a condenser designed for the average wet bulb temperature must also be capable of operating satisfactorily at the highest wet bulb temperatures.

Accordingly, it is an object of the present invention to provide method and apparatus for operating an evaporative condenser system in which the condensing temperature follows the prevailing wet bulb temperature.

It is a further object of the present invention to provide a method for selecting an evaporative condenser capacity based upon the average wet bulb temperature.

Still a further object of the present invention is to provide an energy efficient method of operating an evaporative condenser refrigeration system which utilizes a condenser selected in accordance with the average wet bulb temperature.

Additionally, it is an object of the present invention to ensure energy efficient operation of a compressor in an evaporative condenser refrigeration system by employing a compressor capacity control to ensure operation of the compressor at the lowest practical compressor horsepower.

These and many other objects are achieved by the present invention in a method of operating a refrigeration system including a compressor, a wet condenser, an evaporator, and a coolant circulating therethrough. The coolant flow to the evaporator is established at a fixed rate. The coolant temperature within the condenser, i.e., the condensing temperature, is permitted to follow the prevailing wet bulb temperature surrounding the condenser.

The method of operating an evaporative condenser refrigeration system according to the present invention further includes selecting a suitable condenser having a sufficient capacity for operation at the annual average wet bulb temperature of the locality of the refrigeration system. The evaporative condenser is operated at full capacity at all times during operation of refrigeration system. The condensing temperature of the working fluid in the condenser is permitted to follow the prevailing wet bulb temperature surrounding the condenser at the given time.

According to a further feature of the present invention the capacity of the compressor delivering the working fluid to the condenser is controlled to ensure operation of the compressor at the lowest practical compressor horsepower. Still further, separation between the low pressure portion and the high pressure portion of the system is maintained so that working fluid is delivered at constant pressure to an evaporator even though the condensing pressure varies with the condensing temperature which follows the prevailing wet bulb temperature.

A refrigeration system according to the present invention includes an evaporator, a compressor, a condenser having a coolant flow tube exposed to saturated ambient air, and a network interconnecting the evaporator, the compressor and the condenser through which a coolant flows. The condenser is sized for operation at the annual average wet bulb temperature of the locality and the temperature of the coolant in the condenser is permitted to follow the prevailing wet bulb temperature.

According to the preferred embodiment of the present invention, a controlled pressure receiver is arranged to receive condensed coolant from the condenser. A line delivers fluid from the receiver to the evaporator. The pressure is maintained constant within the receiver by selectively communicating the receiver with either the inlet to the compressor or the outlet from the compressor.

BRIEF DESCRIPTION OF THE DRAWINGS

Preferred embodiments of the present invention will be described in greater detail with reference to the attached drawings wherein like members bear like reference numerals and wherein.

DETAILED DESCRIPTION OF THE PREFERRED EMBODIMENT

Figure 1:
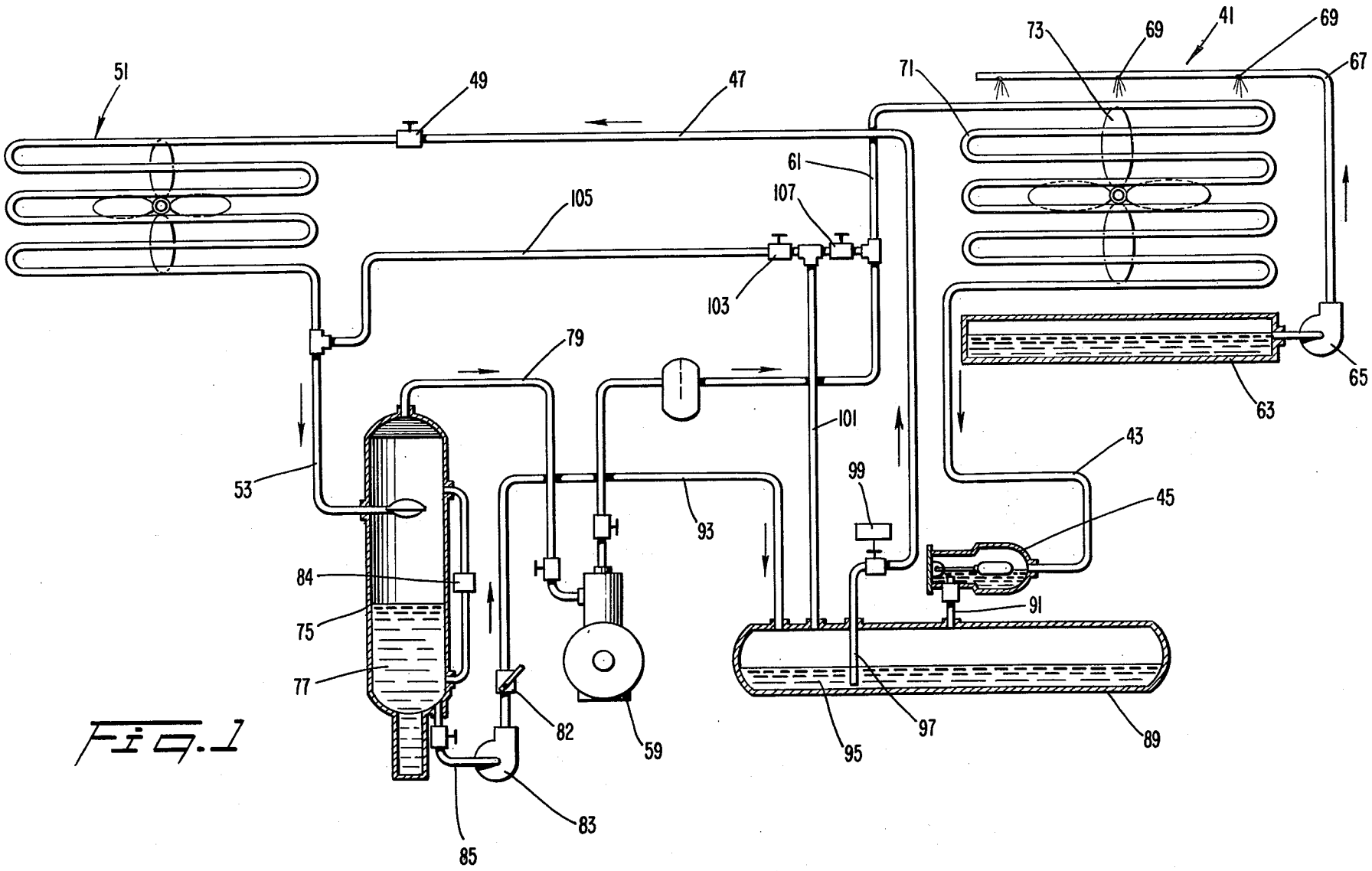
FIG. 1 is a schematic view of a first embodiment of an evaporative condenser refrigeration system according to the present invention.

With reference to FIG. 1, an evaporative condenser refrigeration system includes a conventional chiller or evaporator 51. Relatively cool liquid refrigerant is delivered to the evaporator 51 in a line 47 having a flow control expansion valve 49 of conventional design. The evaporator removes heat from a zone to be cooled, e.g., air in a space or from a liquid, by at least partially vaporizing the refrigerant in the evaporator 51.

Liquid and vaporized refrigerant working fluid flows from the evaporator 51 in a line 53 to a suction separator accumulator 75. In the suction separator accumulator 75, the remaining liquid phase of the refrigerant is separated from the vapor and is retained within a pool 77. The liquid refrigerant in the pool 77 in the accumulator 75 is withdrawn in a line 85. A pump 83 delivers the withdrawn liquid through a check valve 82 in a line 93 directly to a controlled pressure receiver 89. The pump 83 is preferably controlled by a liquid level float activated switch 84 arranged to cooperate with the accumulator 75. The vapor phase is drawn from the accumulator 75 in a line 79 and delivered to the suction inlet of a pump compressor 59 through a line 57. The compressor 59 increases the pressure and temperature of refrigerant and delivers the refrigerant through a line 61 to an evaporative condenser 41 to be cooled and condensed to the liquid phase.

The liquid refrigerant from the condenser 41 is delivered to a high side float 45 through a line 43. The high side float 45 is provided to separate the high and low pressure sides of the refrigeration system and to ensure that the condenser 41 is drained of liquid refrigerant. By maintaining separation between the high and low pressure portions of the refrigeration system, it is ensured that the working fluid is delivered to the evaporator 51 at a constant pressure. This separation is important for operation of the system according to the present invention since the pressure within the condenser 41 (the high pressure portion) varies as the condensing temperature follows the prevailing wet bulb temperature as described in more detail below.

The type of high side float 45 employed is not critical as long as the float effectively maintains separation between the high and low pressure portions of the system and completely drains the condenser 41 of condensed refrigerant. The float for large capacity condensers may, for example, be a Phillips pilot actuated assembly that modulates the flow of refrigerant to the controlled pressure receiver. For smaller capacity condensers, a high side float actuated by the level within the float assembly or an Armstrong liquid seal may be employed.

The high side float 45 delivers condensed refrigerant in a line 43 directly to the controlled pressure receiver 89. An outlet line 97 is arranged within a liquid pool 95 contained within the controlled pressure receiver 89. Liquid is selectively withdrawn in the outlet line 97 from the pool 95 through a solenoid valve 99. The solenoid valve 99 functions to shut off coolant flow to the evaporator 51 when it is desired to stop the refrigeration system. The relatively cool, liquid refrigerant is delivered in a line 47 having a flow control expansion valve 49 into the chiller or evaporator 51.

The pressure within the controlled pressure receiver 89 is maintained at a level slightly above the prevailing suction pressure of the compressor 59. This pressure is maintained within the controlled pressure receiver 89 through a line 101. The line 101 is selectively connected to the suction pressure through an automatic pressure regulating valve 103 and a line 105 which is connected to the line 53 delivering coolant from the evaporator 51 to the suction separator accumulator 75. Further, the line 101 is selectively connected to the discharge pressure of the compressor 59 through an automatic pressure regulating valve 107 connected to the line 61 which feeds the evaporative condenser 41. In this way, the pressure within the receiver 89 can be maintained at a controlled pressure by automatic operation of the appropriate valve 103 or 107 in a known manner.

Due to the low temperature of the liquid 77 in the accumulator 75, the temperature of the liquid 95 within the controlled pressure receiver 89 will be subcooled to a temperature between the temperature of the recirculating liquid from the suction separator accumulator 75 and the liquid temperature corresponding to the pressure in the receiver 89 during operation.

It should be noted that since the pressure differential between the suction separator accumulator 75 and the controlled pressure receiver 89 is relatively small, the horsepower required for the pump 83 to deliver liquid to the controlled pressure receiver 89 is correspondingly low. In the refrigeration system illustrated in FIG. 1, the controlled pressure receiver 89 provides a pump down storage for refrigerant and a constant refrigerant feed pressure to the chiller or evaporator 51.

The evaporative condenser 41 includes a water supply tank 63 from which water is withdrawn by a pump 65. The liquid is delivered in a line 67 to a plurality of spray nozzles 69 arranged at an upper portion of the evaporative condenser 41. As water is sprayed down along convoluted tubes 71 of the evaporative condenser 41, a fan 73 draws air upwardly through the convoluted tubes 71 to withdraw heat from the refrigerant and to cause the refrigerant to be condensed. The water sprayed upon the tube is collected in the tank 63 to be recirculated across the convoluted tubes 71 of the evaporative condenser 41. In other words, the condenser 41 is a wet heat exchanger and the saturated air created by the water sprays 69 around the tube 71 is essentially at the prevailing wet bulb temperature.

It should be noted that the evaporative condenser 41 includes no capacity controls. In other words, by operating the refrigeration system according to the present invention, the fan 73 is constantly running and the entire area of the convoluted tubes 71 is operated at full capacity at all times. Further the nozzles 69 spray a constant amount of water during operation of the system.

The evaporative condenser 41 is selected according to the procedure outlined below such that the evaporative condenser is of sufficient capacity to operate at the desired temperature differential between the condensing temperature and the average wet bulb temperature of the locality in which the refrigeration system is to be used. It should further be noted that assuming a constant load upon the chiller or evaporator 51, the compressor 59 includes a known arrangement for reducing the capacity, or unloading the compressor, to produce the required tons of refrigeration in the evaporator at the lowest practical compressor horsepower. The compressor unloading feature may also be desirable when the system operates with a varying load upon the chiller. By following the prevailing wet bulb temperature, the system functions satisfactorily at all wet bulb temperatures but still requires less compressor horsepower than a conventional refrigeration system.

Compressor capacity regulation may be accomplished by cycling multiple compressors, by conventional compressor cylinder unloaders, or by variable speed control of the compressor. Each of these regulation devices is known and is readily applicable for use with the present invention.

Figure 2:
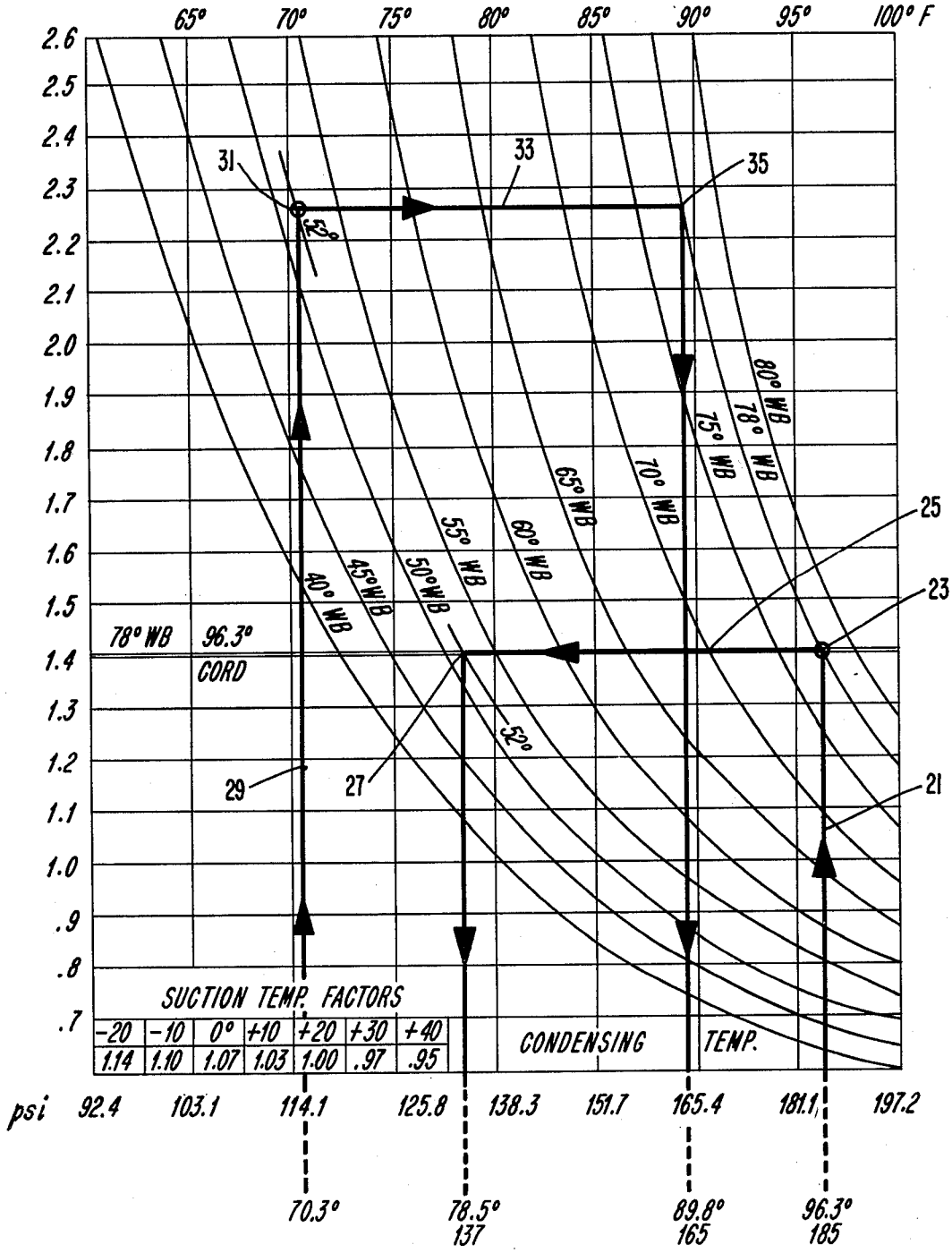
FIG. 2 is a graph illustrating one example for selecting an evaporative condenser capacity according to the present invention.

With reference to FIG. 2, a graph for selecting an evaporative condenser capacity includes a vertical axis representing condenser selection factors and a horizontal axis representing the condensing temperature and pressure of a working fluid within the refrigeration system. It should be noted that the graph illustrated in FIG. 2 is given by way of example only. The system represented in the graph of FIG. 2 uses ammonia as a working fluid and is based upon a 20° F. suction temperature at the compressor inlet. However, it is intended that the method according to the present invention is adaptable to any working fluid at any desired suction temperature. Suction temperature factors are also listed in FIG. 2 in the lower left hand corner of the graph and may be used to adapt a selected condenser capacity to different suction temperatures.

According to the present invention, the selection of the condenser capacity is based upon the average wet bulb temperature of the locality rather than the highest normal wet bulb temperature. By way of example, it has been found that a locality having a highest wet bulb temperature of 78° F. has an annual wet bulb temperature of only 52° F. As can be seen, the difference between the highest wet bulb temperature and the average wet bulb temperature is considerable. Accordingly, if a condenser of a refrigeration system can be arranged to function at full capacity as the condensing temperature follows the average wet bulb temperature rather than controlling the condenser capacity to maintain the condensing pressure corresponding to the highest wet bulb temperature, a substantial savings can be realized. Moreover, by permitting the condensing temperature to follow the wet bulb temperature, the condenser is also able to function satisfactorily at the highest wet bulb temperature.

It should be noted that many manufacturers of evaporative condensers do not regularly release data relating to the performance of condensers at low wet bulb temperatures. This deficiency in data occurs since, as noted above, the usual method of selecting an appropriate condenser is based upon the highest wet bulb temperature.

In order to operate a refrigeration system with the condenser capacity selected at the average wet bulb temperature, the operation of the system must be altered. In particular, the condensing temperature, instead of being maintained by varying condenser capacity as in the prior systems, is allowed to follow the prevailing wet bulb temperature. In this way, the condenser is always operated at full capacity regardless of the change in wet bulb temperature. The temperature and consequently the pressure of the working fluid supplied to the condenser are constantly varying. The lower condensing temperature along with an increased capacity of the selected condenser, as described below permits the refrigeration system according to the present invention to function efficiently at all wet bulb temperatures.

In order to operate the condenser at a 52° F. wet bulb design temperature, an appropriate temperature differential between the wet bulb temperature and the condensing temperature must be selected. For purposes of illustration, the condenser capacity will be selected for operation at an accepted temperature differential between the wet bulb temperature and the condensing temperature of 18.3° F. which is sufficient to obtain proper condensation of the refrigerant. Therefore, the average condensing temperature based upon the average wet bulb temperature of 52° F. in the given example, would be 70.3° F. resulting in an average condensing pressure of only 115 pounds per square inch (FIG. 2). Following a line 29 of constant temperature (70.3° F.) and pressure (115 psi) to an intersection point 31 with the 52° F. design wet bulb temperature curve results in a selection factor of 2.26. The thus determined selection factor is multiplied by the tons of refrigeration required by the evaporator of the system to obtain the condenser unit size selected from appropriate manufacturers' data.

Following the 2.26 selection factor line 33 to the highest wet bulb temperature of 78° F. at an intersection point 35 results in a condensing temperature just under 90° F. at the 78° F. wet bulb condition. This condensing temperature results in a pressure of approximately 165 pounds per square inch. At these conditions, the temperature differential is only approximately 12° F. However, due to the large condenser capacity, this smaller temperature differential is sufficient to properly condense the refrigerant working fluid at the condensing temperature of 90° F.

By way of comparison, and referring to FIG. 2, a conventional method of selecting the capacity of an evaporative condenser will be described. A design condition of 78° F. wet bulb temperature is assumed which wet bulb temperature is selected based upon the highest wet bulb temperature attained in a given locality where the evaporative condenser refrigeration system is to be operated. For purposes of comparison, the same 18.3° F. temperature differential between the design wet bulb temperature and the condensing temperature will be employed as in the above example. Consequently, the design condensing temperature is 96.3° F. resulting in a pressure of 185 pounds per square inch (as seen in FIG. 2) when using ammonia as the working fluid. A line 21 of constant temperature (96.3° F.) and pressure (185 psi) on the graph intersects the curve of the selected design wet bulb temperature of 78° F. at a point 23. Following along a horizontal line 25 from the intersection point 23 leads to a condenser capacity factor of 1.41. The thus determined selection factor is multiplied by the tons of refrigeration required of the system to obtain the condenser unit size selected from appropriate manufacturers data.

The selection of the condenser capacity at the 78° F. highest wet bulb temperature results in a condenser which is approximately 38% smaller than that selected at the 52° F. average wet bulb temperature according to the present invention. Stated another way, since the condenser selected at the average wet bulb temperature results in a condenser capacity of 2.26, the capacity is approximately 60% greater than the capacity of the condenser selected at the highest wet bulb temperature.

As noted above, a locality having a highest wet bulb temperature of 78° F. has an annual average wet bulb temperature of only 52° F. Following the conventional capacity selection factor line 25 to an intersection point 27 with the 52° F. wet bulb temperature curve renders a condensing temperature of 78.5° F. at a pressure of 137 pounds. This temperature would result in a 26.5° F. temperature differential, on the average, for the operation of the conventionally selected condenser capacity if the condensing temperature was allowed to follow the wet bulb temperature. As can be seen, this 26.5° F. temperature differential is larger than the originally selected 18.3° F. temperature differential. This increase results in higher compressor horsepower requirements than the compressor horsepower required when the condenser is selected for the average wet bulb temperature of 52° F. In typical refrigeration systems, a condenser capacity control is employed to reduce the condenser capacity when the condensing pressure decreases below the design condition thereby artificially maintaining the condensing temperature and pressure at the selected level.

As can be seen, by selecting the condenser capacity factor at the average wet bulb temperature, the refrigeration system operates at substantially lower condensing temperatures and pressures at all times. This decreased condensing temperature and pressure results in a reduced power requirement for the compressor feeding the evaporative condenser. In essence, the saving realized at the compressor is equal to the difference in horsepower required to operate the compressor such that the working fluid is delivered to the condenser at an average of 96.3° F. and 185 pounds per square inch versus delivering the working fluid to the condenser at an average of 70.3° F. and 115 pounds per square inch. To illustrate the potential savings, a typical example, assuming a constant evaporator load, follows.

When a reciprocating compressor feeding the evaporative condenser is operated at a fixed speed and constant suction pressure and the condensing temperature is lowered, two specific effects are produced. First, the compressor horsepower is reduced, and second, the compressor capacity is increased. Both of these effects are caused by the reduction in the ratio of compression within the compressor. Assuming a four cylinder compressor having a 4½ inch bore and a 4½ inch stroke at a 20° F. suction temperature the following values result:

| DISCHARGE PRESSURE PSI | CONDENSING TEMPERATURE °F. | RATED TONS OF REFRIGERATION | RATED BHP | BHP PER TON OF REFRIGERATION |
|---|---|---|---|---|
| 185 | 96.3 | 65.2 | 79.7 | 1.222 |
| 115 | 70.4 | 73.7 | 57.5 | — |
| 115 | 70.4 | 65.2 | 51.1 | .784 |
| Reduction in horse power | | | 28.6 | .438 |

It should be noted that the second discharge pressure of 115 psi requires a known arrangement for compressor unloading to decrease the compressor capacity to produce the desired 65.2 tons of refrigeration. This unloading is required since, as noted above, the compressor capacity increases with a decrease in condensing temperature. The potential horsepower savings is accordingly 0.438 over 1.22 which equals approximately 35.9%. The 35.9% savings in compressor energy is quite substantial especially in view of the fact that no special equipment is required. Accordingly, many existing systems can be easily modified to use the method of operation according to the present invention.

Based upon 65.2 tons of refrigeration at 20° F. suction temperature and a cost for electrical energy of 4 cents per kilowatt hour, the potential annual savings according to the present invention is quite substantial. Assuming 20 hours per day, 5 days per week of system operation, the annual operating time is approximately 5200 hours. Further assuming a motor efficiency of 0.85, the following equation for the reduction in energy consumption results:

$$\frac{28.6\ \text{HP} \times 746\ \text{watts/HP}}{.85 \times 1000} = 25.1\ \text{kilowatt hours}$$

Accordingly, 5200 hr×25.1 kwh.×$0.04=$5220.80 is the potential annual savings in the present example.

It should be noted that the evaporative condenser is selected for operation at the lowest practical temperature differential based upon the annual average wet bulb temperature. In the given example, 18.3° F. was utilized as an appropriate temperature differential. However, a smaller differential may be practical for some applications.

It should be further noted that according to the present invention a condenser capacity greater than that employed in existing systems is required. However, although the initial cost of such an increased condenser capacity may be substantial, the energy savings, particularly in view of the rapidly increasing cost of energy, is likely to offset the initial capital investment in a short period of time. As noted for the conditions in the example, the condenser capacity according to the present invention is approximately 60% greater than that required using a conventional selection process. The increased capacity of the condenser is required since the design wet bulb and condensing temperatures are considerably lower than that of the prior systems. Further, it should be noted that the condenser of the present invention is always operating at full capacity. The condensing temperature is allowed to follow the prevailing wet bulb temperature rather than maintaining the condensing temperature artificially high by reducing the condenser capacity.

Figure 3:
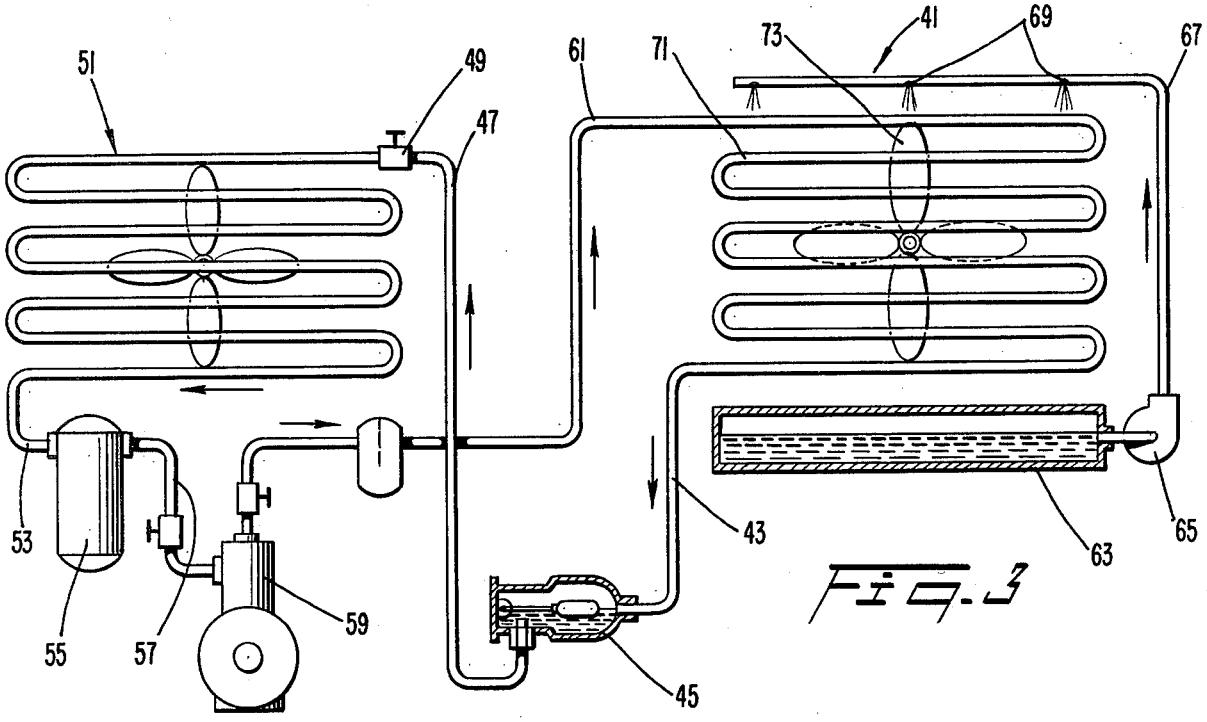
FIG. 3 is a schematic view of a second embodiment of evaporative condenser refrigeration system according to the present invention.

With reference to FIG. 3, a simplified high side float evaporative condenser refrigeration system is illustrated. By eliminating the controlled pressure receiver 89, the condensed refrigerant from the condenser 41 is delivered directly from the high side float 45 through the line 47 and the expansion valve 49 to the evaporator 51. A critical refrigerant charge is used so that substantially all of the refrigerant liquid is vaporized in the evaporator 51. An accumulator 55 is preferably provided to protect the compressor 59 in the event that a small amount of liquid leaves the evaporator 51 with the vaporized refrigerant. The refrigeration system illustrated in FIG. 3 does not include any refrigerant storage vessel for service facilities. Accordingly, the refrigerant charge is usually dumped when servicing is required.

The power requirements for the compressor 59 may be slightly increased due to superheating of the refrigerant vapor entering the compressor 59. However, by selecting the evaporative condenser 41 according to the procedure outlined above, the average condensing pressure of the fluid in the condenser is reduced since the condensing temperature is permitted to follow the prevailing wet bulb temperature. Accordingly, the power requirements of the compressor are less than that required under known operating conditions. It should again be noted that no capacity controls are provided on the condenser 41.

Figure 4:
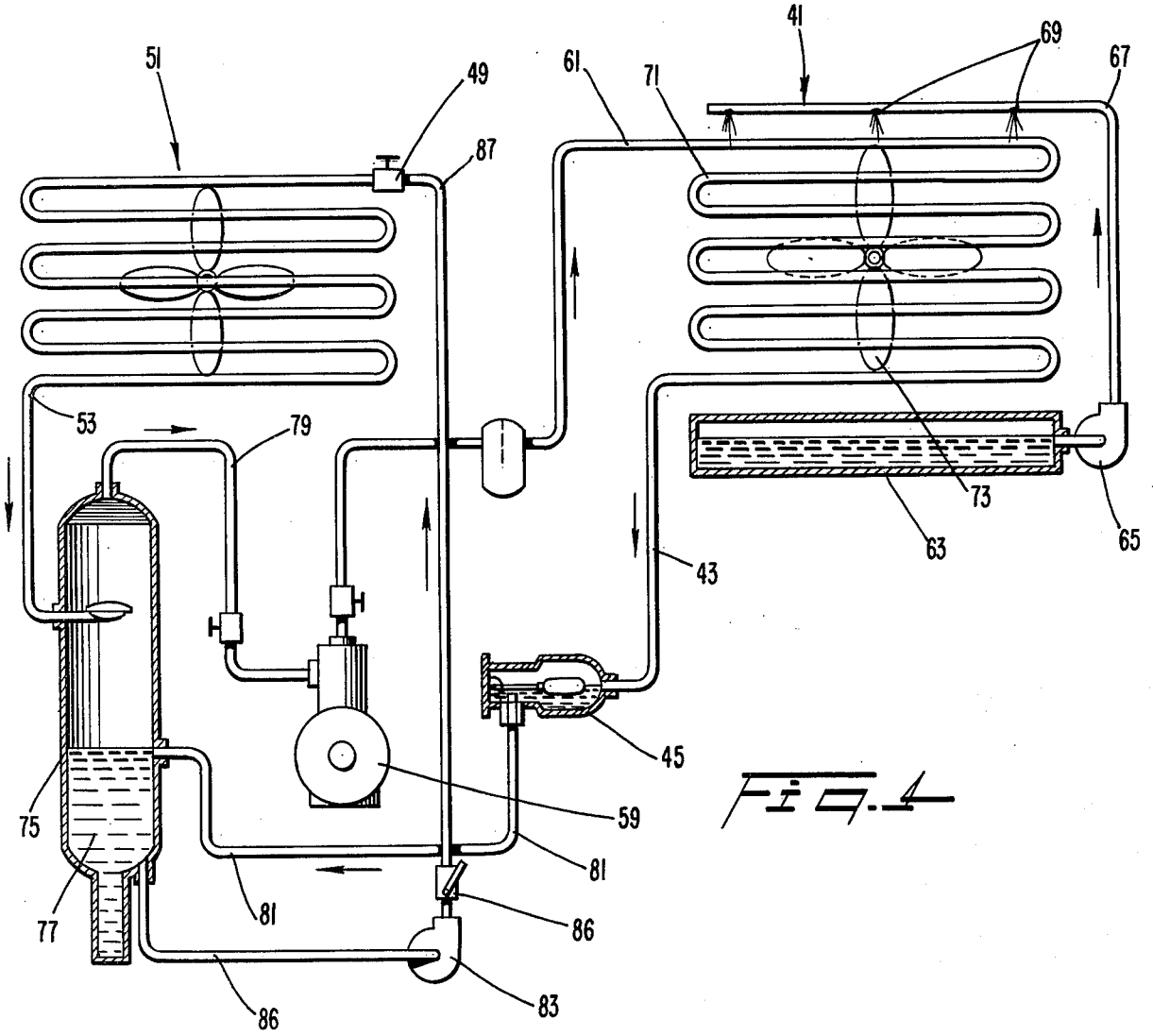
FIG. 4 is a schematic view of a third embodiment of an evaporative condenser refrigeration system.

With reference to FIG. 4, a modification of the refrigeration system of FIG. 3 employs the suction separator accumulator 75 which receives the partially vaporized refrigerant in the line 53 from the chiller or evaporator 51. Within the suction separator accumulator 75, the remaining liquid phase of the refrigerant is retained within the pool 77 and the vapor phase is drawn from the accumulator 75 in the line 79 into the suction inlet of the compressor 59. Liquid refrigerant condensed in the evaporative condenser 41 is delivered from the high side float 45 in a line 81 to be deposited within the liquid refrigerant pool 77 in the suction separator accumulator 75. Liquid refrigerant from the pool 77 is delivered to a pump 84 in a line 86 which pump 84 delivers refrigerant at constant pressure through a check valve 86, a line 87 and the flow control valve 49 to the evaporator 51.

Again, the refrigeration system illustrated in FIG. 4 does not contain any capacity controls upon the evaporative condenser 41. Assuming the evaporative condenser 41 has been selected according to the principles of the present invention, the evaporative condenser 41 is operated at full capacity at all times. Unloading of the capacity of the compressor 59 is highly desirable assuming a constant load upon the chiller or evaporator 51 in order to ensure that the compressor capacity utilized is only that required for the constant refrigeration load at the lower wet bulb temperatures. The system illustrated in FIG. 4, as does the system of FIG. 3, requires a critical charge but the accumulator 75 is sized to hold the maximum charge for servicing.

While the above embodiments of a refrigeration system utilizing the principles of the present invention have been described with reference to a single condenser 41, it is to be understood that the system may be operated with two or more evaporative condensers. If more than one evaporative condenser is employed a separate high side float for each condenser is preferred. Further, if the evaporator load is variable, compressor capacity control is also desirable to ensure that the desired evaporator refrigeration load is obtained while using a minimum compressor horsepower requirement.

The principles, preferred embodiments, and mode of operation of the present invention have been described in the foregoing specification. However, the invention which is intended to be protected is not to be construed as limited to the particular embodiments disclosed. The embodiments are to be regarded as illustrative rather than restrictive.

Variations and changes may be made by others without departing from the spirit of the present invention. Accordingly, it is expressly intended that all such variations and changes which fall within the spirit and scope of the present invention as defined in the claims be embraced thereby.

What is claimed is:

1. A method of operating an evaporative condenser refrigeration system, comprising the steps of:

selecting a suitable condensing temperature differential;

selecting a suitable condenser having a sufficient capacity for operation at the average wet bulb temperature of the locality of the system and at the selected temperature differential;

operating the evaporative condenser without capacity controls and at full capacity at all times during operation of the refrigeration system;

permitting the condensing temperature of the working fluid in the condenser to continuously follow the prevailing wet bulb temperature of the locality;

maintaining a seperation between a high pressure portion and a low pressure portion of the refrigeration system; and controlling the flow rate of condensed working fluid to an evaporator with a flow control valve downstream of the separation between the high and low pressure portions.

2. An energy efficient method of operating a refrigeration system including a compressor, a wet condenser, an evaporator, and a coolant circulating therethrough, comprising the steps of:

removing heat from a zone to be cooled in the evaporator by at least partially vaporizing the coolant therein;

delivering the vaporized coolant to the compressor;

compressing the coolant in the compressor and delivering the compressed coolant to the condenser;

permitting the coolant temperature in the condenser to continuously follow the prevailing wet bulb temperature of the locality of the system;

maintaining separation between a high pressure portion of the system including the condenser and a low pressure portion of the system including the evaporator; and controlling the flow rate of condensed coolant to the evaporator with a flow control valve downstream of the separation between the high and low pressure portions.

3. A refrigeration system comprising:

a coolant;

evaporator means for removing heat from a zone to be cooled by at least partially vaporizing the coolant;

compressor means for increasing the pressure of the vaporized coolant;

condenser means for condensing the pressurized coolant from the compressor, said condenser means including a coolant flow tube exposed to saturated ambient air;

said condenser means being sized for operation at the average wet bulb temperature of the locality of the system and including no capcity controls;

the condensing temperature of the coolant in said condenser means being permitted to continuously follow the prevailing wet bulb temperature of the locality of the system;

a network including a flow control valve for conducting the condensed coolant from the condenser to the evaporator means; and separation means for maintaining separation between the pressure in the condenser means and the pressure in the evaporator means, said separation means being arranged in said network upstream of the flow control valve.

4. The method according to claim 1, further comprising the step of controlling the capacity of a compressor system delivering the working fluid to the condenser to ensure that the temperature of the working fluid delivered to an evaporator is maintained at a desired value using the minimum required compressor horsepower.

5. The method according to claim 1, further comprising the step of feeding the working fluid at a substantially constant pressure to the evaporator.

6. The method according to claim 5, wherein the step of feeding constant pressure working fluid to the evaporator includes:

depositing condensed working fluid from the condenser in a closed receiver having a vapor space;

maintaining the pressure within the receiver by selectively subjecting the receiver to suction pressure or discharge pressure of a compressor system for the condenser.

7. The method according to claim 2, further comprising the step of operating the condenser at full capacity at all times during the operation of the system.

8. The method according to claim 2, further comprising the step of operating the system at a design condition based upon the average wet bulb temperature for the locality of the system.

9. The method according to claim 2, further comprising the step of controlling the capacity of the compressor system delivering fluid to the condenser to ensure that the desired refrigeration load on the evaporator is maintained while using the minimum required compressor horsepower.

10. The refrigeration system of claim 3, further comprising means for separating the liquid phase and the gaseous phase of the coolant from the evaporator, only said vapor phase being compressed in said compressor means.

11. The refrigeration system of claim 3, further comprising:

receiver means for receiving condensed coolant from the condenser means, said receiver means being arranged in the network between said separation means and said expansion valve;

means for withdrawing liquid from said receiver means and for delivering liquid to the expansion valve; and means for maintaining the pressure in the receiver means constant.

12. The refrigeration system according to claim 11, wherein the means for maintaining constant pressure in the receiver means comprises means for selectively subjecting the receiver means to the pressure of an inlet to the compressor means or an outlet from the compressor means.

* * * * *